US005215011A

United States Patent [19]

Monney

[11] Patent Number: 5,215,011

[45] Date of Patent: Jun. 1, 1993

[54] DEVICE FOR SCANNING PALE COLOR MARKS ON A PRINTING MACHINE

[75] Inventor: Patrick Monney, Villars Ste-Croix, Switzerland

[73] Assignee: Bobst SA, Switzerland

[21] Appl. No.: 879,776

[22] Filed: May 6, 1992

[30] Foreign Application Priority Data

May 6, 1991 [CH] Switzerland ..... 01327/91

[51] Int. Cl.[5] ..... B41F 5/16

[52] U.S. Cl. ..... 101/181; 101/248; 250/561; 250/548; 356/429; 382/8; 382/62

[58] Field of Search ..... 101/181, 211, 248, 171; 356/402, 421, 422, 425, 429; 250/548, 559, 561, 563; 382/8, 62

[56] References Cited

U.S. PATENT DOCUMENTS

| | | | |
|---|---|---|---|
| 4,534,288 | 8/1985 | Brovman | 101/211 |
| 4,546,700 | 10/1985 | Kishner et al. | 101/211 |
| 4,932,320 | 6/1990 | Brunetti et al. | 101/181 |
| 4,947,746 | 8/1990 | Jeschke et al. | 101/211 |
| 5,076,163 | 12/1991 | Sainio | 101/181 |
| 5,122,977 | 6/1992 | Pfeiffer | 101/211 |
| 5,125,037 | 6/1992 | Lehtonen et al. | 382/8 |
| 5,126,578 | 6/1992 | Roch et al. | 250/548 |

FOREIGN PATENT DOCUMENTS

| | | |
|---|---|---|
| 0283899 | 9/1988 | European Pat. Off. . |
| 3311352C1 | 3/1984 | Fed. Rep. of Germany . |

OTHER PUBLICATIONS

Patent Abstracts of Japan, vol. 10, No. 372, Dec. 11, 1986; Shinichi Furuya; "Detector for Printing Paper with Defective Density Register".

*Primary Examiner*—Eugene H. Eickholt

*Attorney, Agent, or Firm*—Hill, Steadman & Simpson

[57] ABSTRACT

A device for scanning marks printed on workpieces travelling under a light source includes at least two parallel mark scanning channels emitting an electric impulse due to passage of a mark, each channel being sensitive to a particular color. The device incudes, moreover, electronics for selecting a most representative mark impulse among the electric impulses emitted by the channels.

9 Claims, 5 Drawing Sheets

+5V
+5V
72
D
CLK
Q
C
J
75
ET
85
71
73
74
+5V
+5V
+5V
+5V

V1
e2
V2
e1
V2
S11
S12
S1
S2

DEVICE FOR SCANNING PALE COLOR MARKS ON A PRINTING MACHINE

BACKGROUND OF THE INVENTION

The present invention used in a multi-color printing machine refers to a device for scanning various color marks printed by various printing units, the marks allowing a subsequent determination of misregister of a corresponding color with respect to the color printed by the first printing unit and used as a reference.

Known devices such as the one described in the document EP 0 094 027, corresponding to U.S. Pat. No. 4,534,288, operate to satisfaction, provided that the yellow, blue or red marks are sufficiently contrasted for being recognized infallibly by the scanning device. Some of these known devices may operate with a fiber optic light beam hitting the printed workpiece and directing the reflected light onto a scanning photodiode producing an electric signal. In order to enhance the contrast between the electric basic signal corresponding to a non-printed area of the workpiece, and an electric impulse produced by the passing mark, a filter, usually of blue color, is installed between the fiber optic and the photodiode.

However, as soon as the printed colors fade to paleness, especially so when printing packages with pastel yellow, cream or light blue, the conventional devices are no longer capable of detecting safely the various printed marks so that the one or the other register control might fail to operate correctly. In such cases, it might be appropriate to use a first filter, to present a pale color in order to test the quality of the signal obtained, and to repeat the test with one or several other filters so as to select the one most appropriate for all marks. However, the most important phase of the start-up of a printing machine consists in searching the initially unknown position of a concomitant mark which, though, cannot be reliably carried out without an immediately responsive scanning device. Such numerous, and indispensible, tests become quickly inhibitive if the printing machine is to be used for accomplishing a great number of different jobs.

SUMMARY OF THE INVENTION

It is an object of the present invention to create a detector which can spot printed marks whatever their color, intensity and contrast with respect to the background color of the flat workpiece it is printed on.

These purposes are attainable by means of a device scanning printed marks since it comprises at least two parallel mark scanning channels, each of which emit an electric impulse each time the mark travels through under the light source, the photosensitive unit at the inlet of the two channels being responsive to a color frequency range distinguishable from the others, as well as electronic means selecting the most representative mark impulse among the electric impulses emitted by the channels.

Each mark scanning channel comprises:

- a photosensitive unit generating an electric signal for the voltage value, followed, if required, by
  - an amplifying stage with automatic gain for fixing at a predetermined rate the basic voltage corresponding to a non-printed area of the workpiece, followed by
    - a stage for converting the oblique sloped electric impulse called forth by the mark travelling under the photosensitive unit into a steep sloped electric impulse, every steep slope corresponding to the beginning of the ascent or descent of the associated oblique slope,
- and electronic means for selecting among the electric impulses originating from the channels at a given moment the impulse appearing or disappearing first.

Hence, owing to this device, the electric impulse with the strongest contrast is regularly retained whatever the quality of the other impulses considered.

An associated problem, however, might somewhat complicate the conception of the selective circuit since a color mark printed on a white workpiece which will bring forth a negative impulse with respect to the basic signal, whereas a very reflective, say gold or silver, color mark, will bring forth an inversed, i.e. positive, impulse with respect to the basic signal. This problem is obviated in that every scanning channel additionally includes before the converting stage a rectifying stage imposing on all electric impulses a variation in the same direction with respect to the basic voltage.

Appropriately, the photosensitive unit includes a photodiode situated behind a tinted filter and which is connected to the inlet of a current/voltage converter.

In accordance with a preferable mode of realization, the rectifying stage includes a first stage for rating the basic voltage, followed by a stage for subtracting the basic voltage thereby leaving only positive or negative impulses, followed by a stage for rectifying solely the positive impulses into negative ones, followed by a stage for adding all the impulses and, finally, followed by a stage ensuring the re-addition of the basic voltage.

In accordance with a preferable mode of realization, the converting stage includes a first stage for detecting peaks, followed by a second stage for subtracting the inlet signal from the threshold detected by the first stage, the difference being applied to a comparator tilting off as soon as the difference exceeds a predetermined threshold, as well as the first electronic means re-initializing and inversing the detection direction of the peak detecting stage as well as the second electronic means inversing the polarity of the comparative threshold applied to the comparator after a first tilt of the latter.

In accordance with a preferable mode of realization, the electronic means for impulse selection includes a first gate "OU" receiving one of the impulses at both of its inputs and whose output is connected to the clock inlet "CLK" of a first tilting device and as many secondary tilting devices as there are impulses to be analyzed, the impulses being received inversely at their clock input "CLK", all the inversed outputs "$\overline{Q}$" of the secondary tilting devices being connected to the input of a second gate "ET" whose output is connected to the re-initialization input "CL" of the first tilting device, the re-initialization input "CL" of every secondary tilting device being connected to the output "Q" of the first tilting device, and a final line for monitoring electronic means being connected to one of the inputs of the second gate "ET".

In accordance with an appropriate mode of realization, the device includes, moreover, an analog/digital and digital/analog converter connected to a microprocessor destined to receive from the rectifying stage the basic voltage rate and to feed, on the one hand, the amplifying stage with automatic gain, if present, with an electric signal representative for the gain to be applied and, on the other hand, the converting stage with an electric signal representative of the threshold optimal for the comparator. Owing to this latter device, the voltage is permanently held at a rate of about 8 volts, and the comparator detection threshold is fixed at a rate between 200 and 400 millivolts above the average noise emitted with the basic voltage.

The invention will be better understood by examining a realization mode selected as a non-limiting example described by the drawings referred to hereafter.

DESCRIPTION OF THE PREFERRED EMBODIMENT

Figure 1:
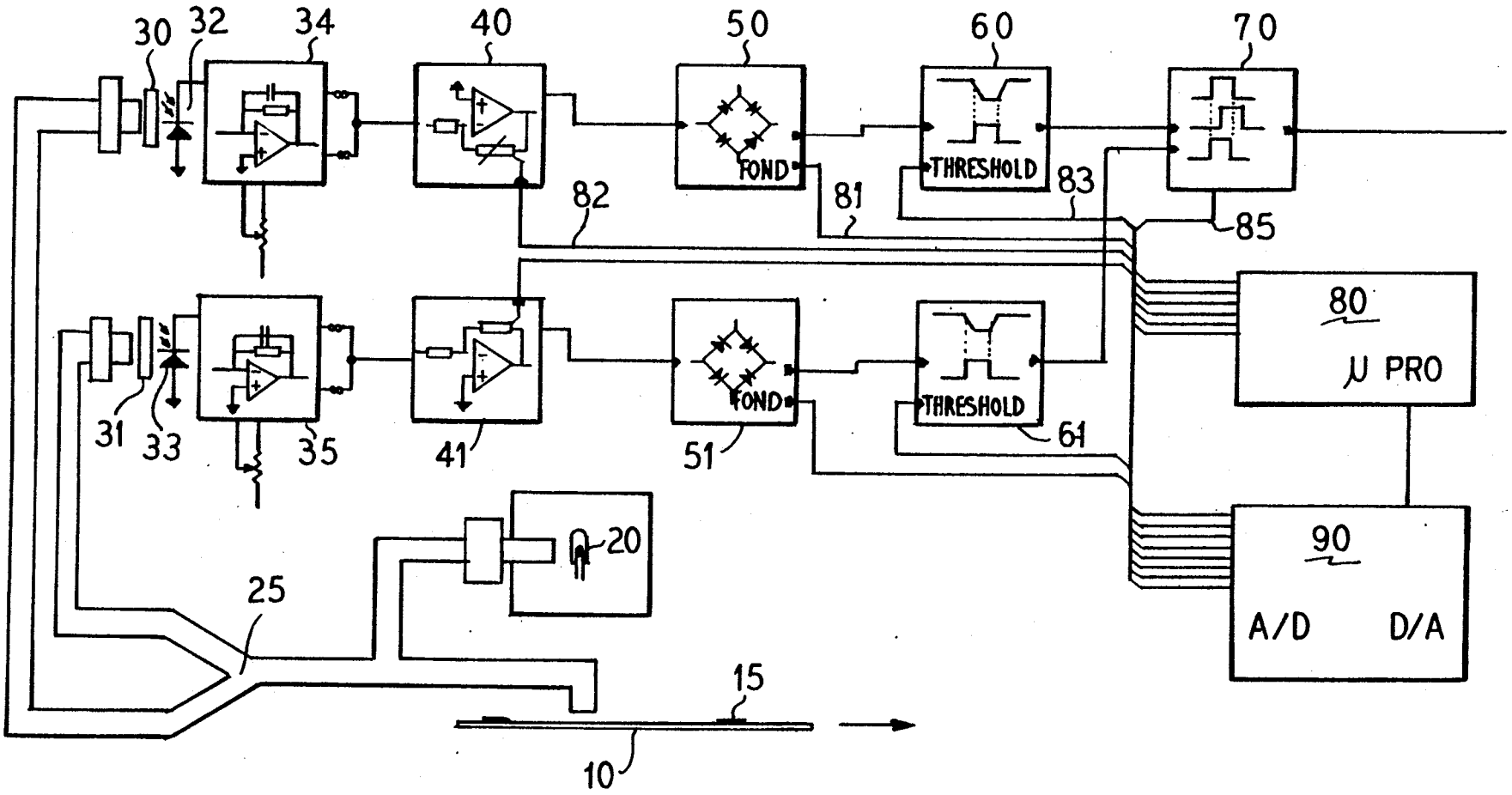
FIG. 1 is a schematic diagram of a device according to the invention.

As illustrated by FIG. 1, the device according to the invention includes a bundle of fiber optics 25 initially transmitting the light emitted by a light source 20 above the printed workpiece 10 provided with color marks 15 printed on its upper side. These workpieces might be paper strips or cardboard plates undergoing a manufacturing process. Such marks 15 are printed in an unrestrained area of the workpiece and with the color printed by each printing unit. The passage of these marks 15 under the fiber optics temporarily modifies more or less the reflected light which, after splitting in half of the fiber optic bundle, is transmitted to two separate photodiodes 32, 33.

According to the invention, the photodiodes 32, 33 are each rendered sensitive to distinct colors by means of filters 30, 31 situated between the output of the fiber optic bundle and the photodiodes. So, for instance, the filter 30 can be dark violet enhancing yellow marks, whereas the filter 31 is green enhancing blue marks. The electric signals emitted by each photodiode are initially conditioned separately and in parallel by identical processing channels consisting of the circuits 34, 40, 50 and 60, and then compared by a selective circuit 70.

These identical and parallel conditioning channels each include a current/voltage converter 34 producing a voltage variation from the intensity variations occurring within the photodiode and caused by the mark 15 passing under the fiber optic. As symbolically represented, this current/voltage converter is made in a known way of an operational amplifier and a counter-reactive item situated between its negative output and input. Clamps symbolically arranged at the output allow to put to operation a first or a second counter-reactive circuit, thus modifying the gain of amplification of this stage in a relationship of 1 to 10. This voltage signal is then amplified by an automatic gain amplifying circuit 40 in such a way that the basic signal corresponding to a non-printed area of the workpiece 10 will be fixed at a rate of 8 volts. Because of the background color of the printed workpiece 10, the length of the fiber optic bundle 25, and dust particles which are likely to alter the input or the output of the fibers as well as the filters, the basic voltage received at the output of the current/voltage converter 34 may vary between 150 millivolts and 8 volts.

The electric signal then flows into a rectifying circuit, the purpose of which is to gather all color mark impulses in an identical direction, which in the present case is negative, with respect to the basic voltage. In most cases, the marks 15 are printed with colors which are darker than the background color and thus cause a reduction of the light reflected on the fiber optic, i.e. an instant reduction of the current flowing through the photodiode 30, in other words an impulse with a lower rate than the rate of the basic voltage. Inversely, if the marks 15 appear brighter than the background color, or if they are printed with particularly reflective colors such as gold or silver, the reflected light is temporarily stronger than the basic light and the same effect affects the corresponding electric impulse. By leading all impulses to a same side, this rectifying circuit permits a considerable simplification of the subsequent selective circuit.

Figure 1A:
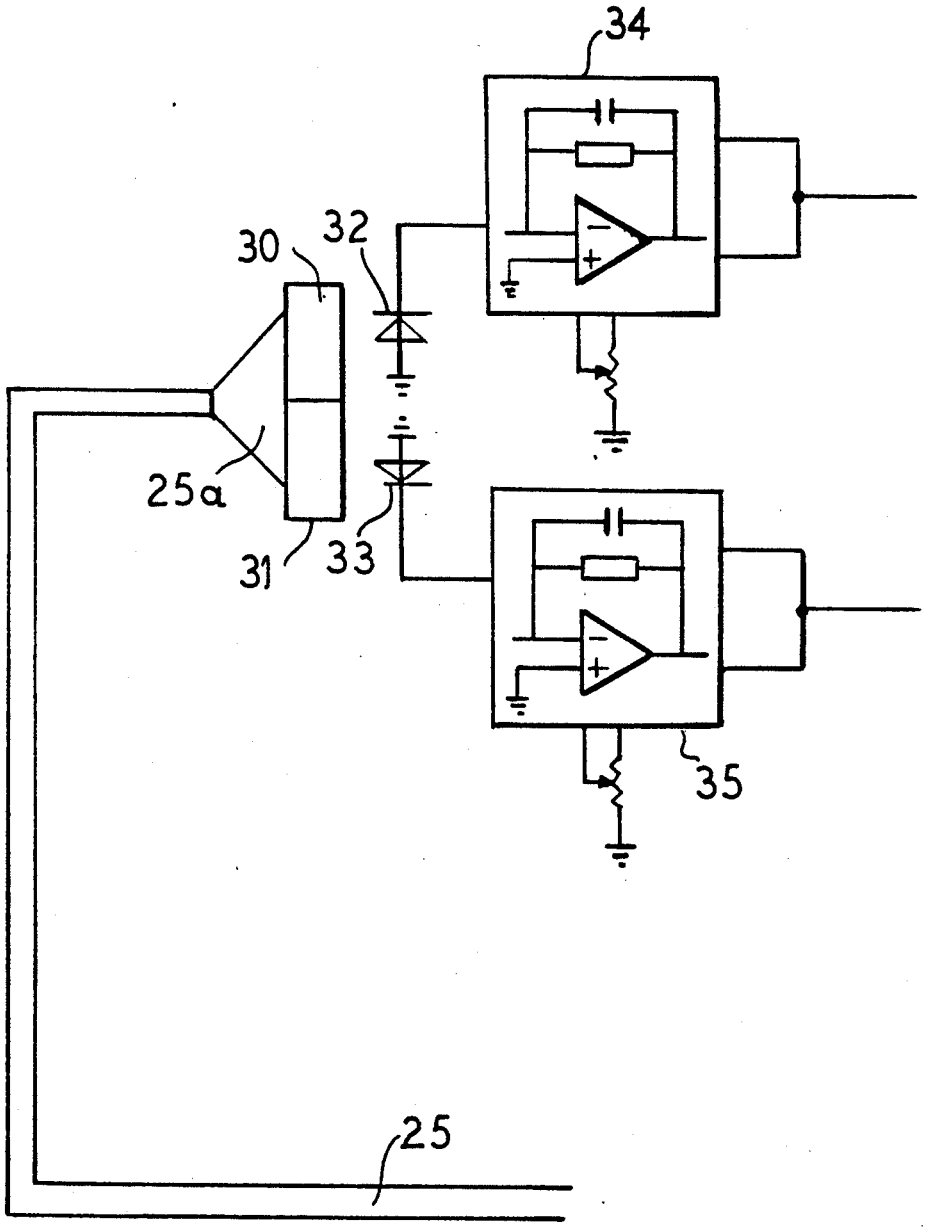
FIG. 1*a* is a partial view of a particular design of the device according to the invention.

FIG. 1*a* represents a device similar to the one of FIG. 1 in which the fiber optic 25 has not been split in half. A light diffusion device 25*a* has been added to the end of the fiber optic 25 so that the reflected light will be indifferently directed to the filters 30 and 31. The design of the other components of the device including the photodiodes 32 and 33, as well as the current/voltage converters 34 and 35, remains unchanged with respect to the lay-out shown by FIG. 1.

Figure 2:
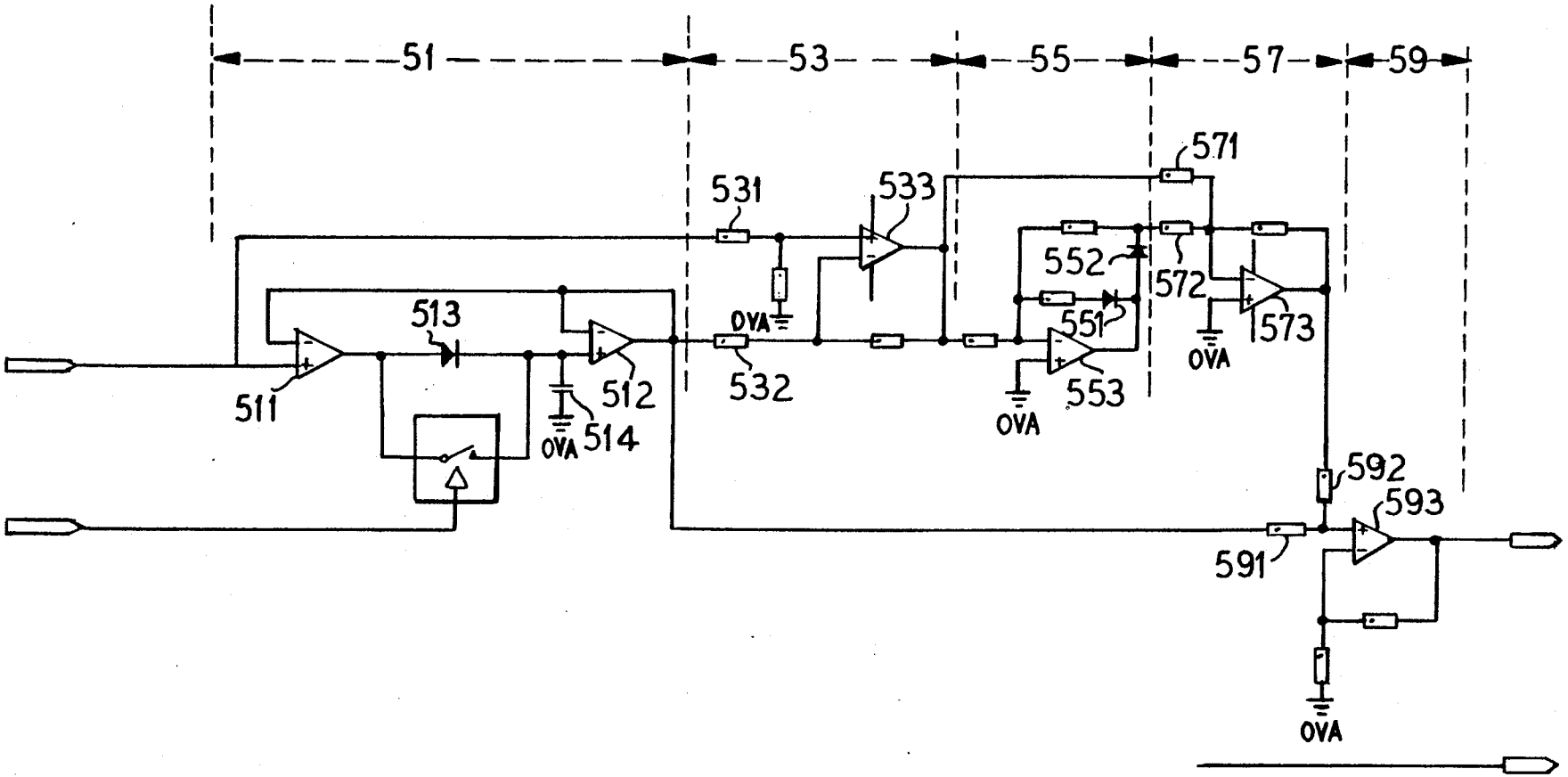
FIG. 2 is a lay-out of the rectifying circuit operating in the device of FIG. 1.

If reference is made to FIG. 2, this rectifying circuit 50 includes a background rating stage 51, followed by a background subtracting stage 53, followed by the effectual rectifying stage 55, followed by an impulse adding stage 57, terminated by a background re-adding stage 59.

As illustrated, the background rating stage 51 essentially includes the combination of a diode 513 and a capacitor 514, the other line of which is grounded. The operational amplifiers 511 and 512 act as insulators of the stage. By temporarily short-circuiting the diode 513, the switch 515 permits a periodic re-initializing of this background rate.

The subtracting stage includes in a known way an operational amplifier 533 receiving the complete signal through the resistor 531 on its positive input as well as the background value to be subtracted through the resistor 532 at its negative input.

At the rectifying stage 55, only positive impulses are amplified and inversed by the operational amplifier 553 comprising two diodes 551, 552 in its counter-reactive circuit. The addition, by the operational amplifier 573, of the adding stage 57, fed through its negative clamp with the signal originating directly from the subtracting stage 53 through the resistor 571 as well as with the amplified negative impulses used for balancing the positive impulses, provides at the output of this stage a sequence of impulses of the same amplitude as initially, though with all impulses in the negative direction.

The operational amplifier 593 of the re-adding stage 59 adds the background value transmitted direct from the first background rating stage 51 through the resistor 591 and the impulses emitted by the adding stage 57 through the resistor 592.

If reference is made to FIG. 1, the rectifying circuit 50 is followed by a circuit 60 converting the oblique-sloped impulses into steep-sloped ones which latter provide easier subsequent logical processing.

Figure 4:
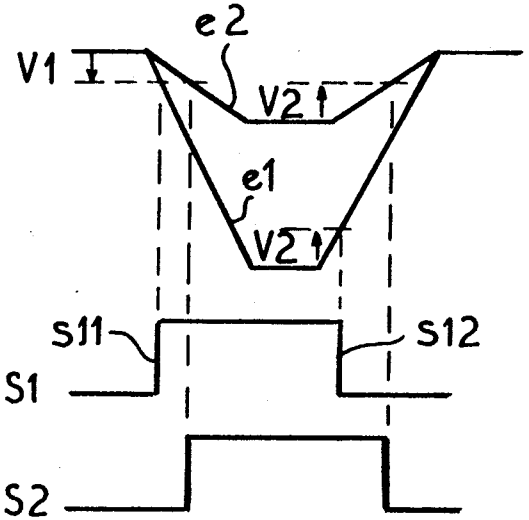
FIG. 4 is a diagram of the operation carried out by the converter of FIG. 3.

As illustrated in FIG. 4, the impulses e1 and e2 generated by the photodiodes 32 or 33 show a first descending oblique slope corresponding to the progressive penetration of the mark into the fiber optic scanning area, followed by a bottom level appearing with the mark body passing, and terminated by a second ascending slop corresponding to the mark progressively leaving the scanning area.

The detailed structure of this converter 60 will be described in connection with FIG. 3 in which four important stages are distinguishable, i.e. a peak detecting stage 61, followed by a stage 62 for subtracting the measured peak from the instantaneous signal, followed by a stage 63 for comparing the difference with a predetermined threshold originating from a stage 64. The result of this comparison is shaped by the operational amplifier 632, the inverse signal of which is generated by the inverter 633. The output of the shaping amplifier 632 is also used as a counter-reactive item destined to inverse the direction of the maximum detection rate of the stage 61 and to modify the threshold rate originating from the stage 64.

The peak detecting stage 61 essentially includes a diode 614 (and then 615) acting jointly with a capacitor 613 whose input is controlled by the amplifier 611 and whose output is controlled by the operational amplifier 612. The direction of the maximum detection rate, either in the ascent or descent, is initially determined b the state of the relay 65 selecting either diode 614 or 615. This stage is re-initialized by the relay 644 after a short period added by the inverter 633 by means of the diodes 616 or 617, depending on the case.

The subtracting stage 62 receives the signal originating from the peak detecting stage 61 through the resistor 621 as well as, through the resistor 622, the instantaneous signal previously amplified by the operational amplifier 619 with a gain of 1. The comparison is ensured by the amplifier 631 receiving the threshold signal a its positive input and the difference signal at its negative input.

Figure 3:
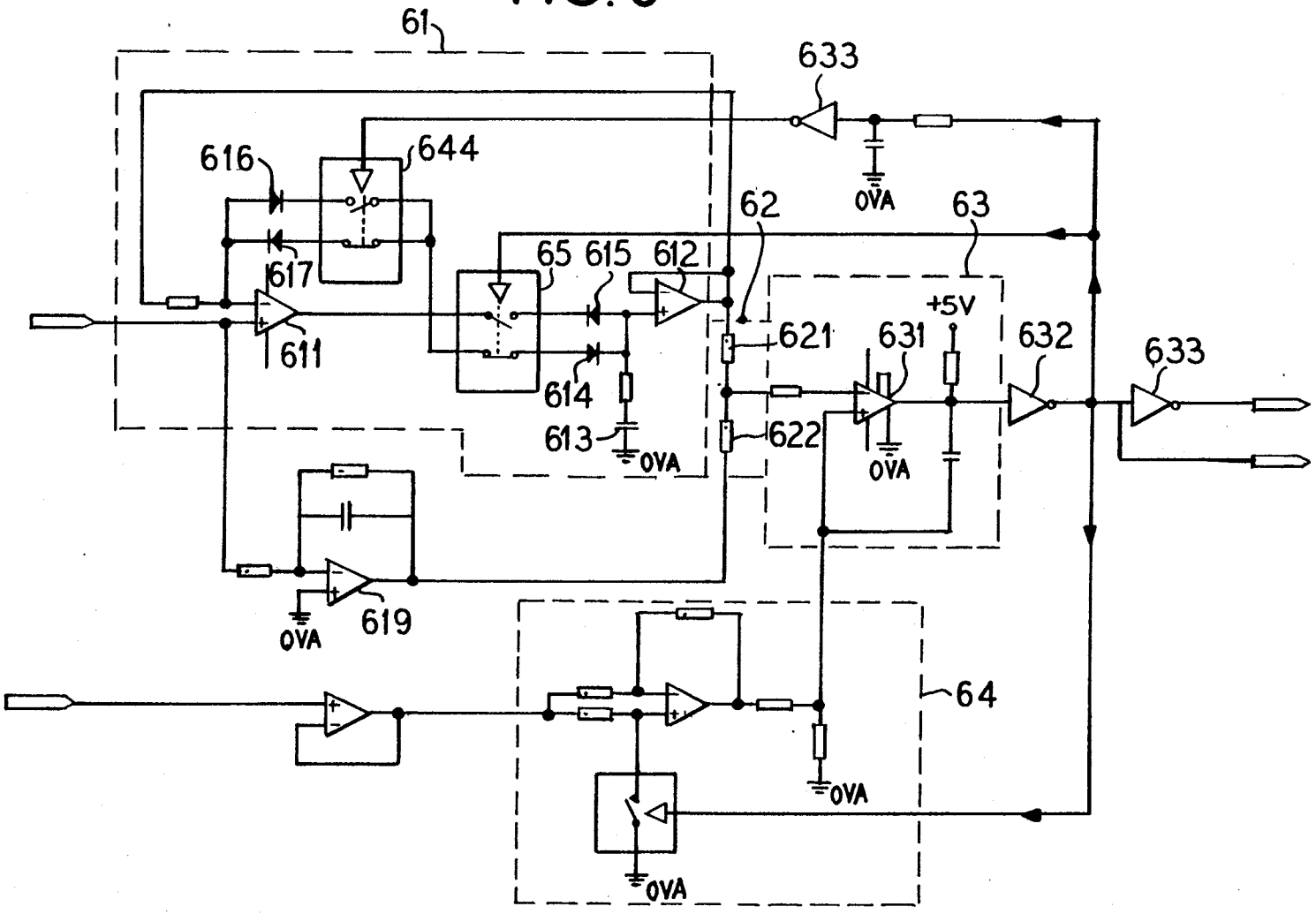
FIG. 3 is a lay-out of the converting circuit operating in the device of FIG. 1.

As may easily be understood from FIGS. 3 and 4, the stage 61 first receives the rate of the basic voltage, whereas the output of stage 62 first provides a zero signal which is to increase only with the appearance of the descending oblique slope of an impulse. If the oblique slope of this impulse exceeds a predetermined threshold v1 with respect to the basic voltage, the operational amplifier 631 will tilt and a first steep voltage ascent s11 will appear at the output of the inverter 632. This voltage ascent s11 begins by causing the selection of the diode 615 enabling the capacitor 613 to be discharged through the diode 617 and then the diode 616 to be connected after a period to be determined by the inverter 633. The stage 61 is then ready for detecting a new maximum, though in the descending direction. The first voltage ascent has also caused at the stage 64 a modification of the threshold voltage v2 by grounding the positive input gate of an operational amplifier.

The stage 61 then detects the rate of the lower bottom level of the impulse e1, whereas the output of the subtracting stage 62 remains at zero rate as long as the bottom level lasts. Once again, with the appearance of the beginning of the ascending oblique slope of the inlet impulse the difference at the outlet of the stage 62 will increase and even exceed the new threshold v2 of the comparator 631 which then will invert itself, thereby causing a sudden descent s12 of the shaping amplifier 632.

In this way, the steep ascending slope of the outlet impulse s1 corresponds more or less to the beginning of the descending oblique slope of the inlet impulse e1, whereas the steep descending slope of the outlet impulse s1 corresponds more or less to the beginning of the reascending oblique slope of the inlet impulse e1.

As may be gathered from FIGS. 1 and 4, the impulses s1 and s2, now castellated, and respectively emitted by the channel corresponding to the yellow color and the channel corresponding to the blue color, are applied to the selective circuit 70 retaining the ascending impulse s1 which will descend first and correspond to the initial oblique slope of the most contrasted impulse e1.

Figure 5:
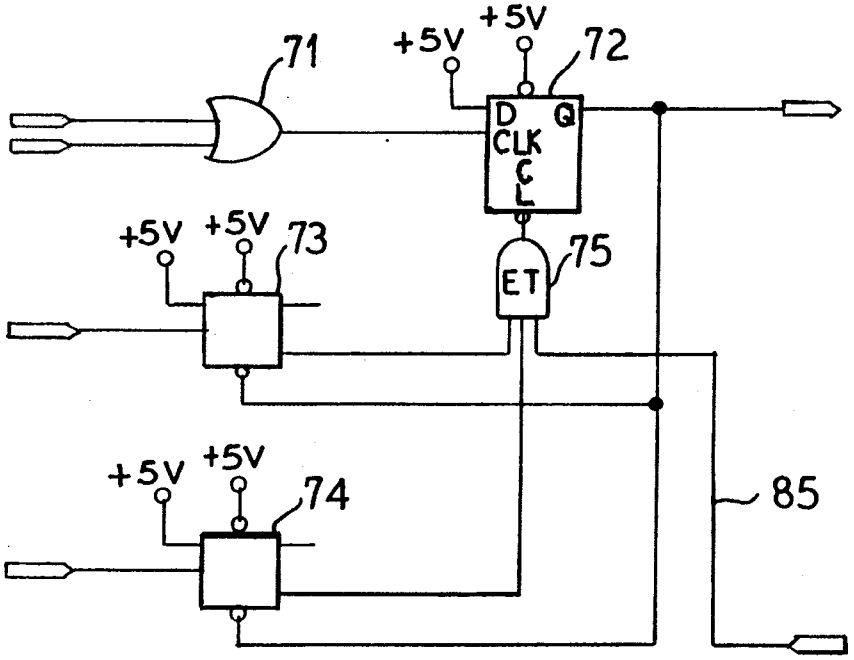
FIG. 5 is a lay-out of the selective circuit operating in the device according to FIG. 1.

The mode of realizing the circuit 70 as illustrated by FIG. 5 includes a first gate "OU" 71 receiving one of the castellated impulses at both of its inputs and whose output is connected to the clock inlet "CLK" of a first tilting device 72. The selective circuit 70 includes as many secondary tilting devices 73, 74 as there are impulses to be analyzed, these impulses being received inversely, i.e. at their clock input "CLK". All the inversed outputs "$\overline{Q}$" of the secondary tilting devices are connected to the input of a second gate "ET" 75 whose output is connected to the re-initialization input "CL" of the first tilting device 72. Moreover, the output "Q" of this first tilting device 72 is also connected to the re-initialization input "CL" of each of the secondary tilting devices 73, 74. A last permitting or interlocking line 85 of the selective circuit 70 is connected to one of the inputs of gate "ET" 75.

At the initial state of the device, all inputs of the gate "ET" 75 are at a high rate, thus releasing the first tilting device 72 whose output "Q" is initially at a low rate, entailing the interlocking of the tilting devices 73 and 74. With an impulse reaching one of the inputs of the gate 71 the output of this gate is at a high rate resulting in the appearance of a high rate on the output gate "Q" of the tilting device 72, which brings about the ascending slope of the output impulse and also releases the tilting devices 73 and 74. The arrival of the ascending slope of the second impulse has then no more effect on the circuit 70. On the other hand, the arrival of the first ascending slope of an inversed signal, corresponding actually to the descending slope of this first impulse, will change the state of the corresponding tilting device 73, 74 resulting in the immediate lowering of the corresponding gate "Q". The gate "ET" 75 will have at least one of its input gates put to a low rate, whereas its output also lowers, resulting in the re-initialization of the first tilting device 72, and putting the corresponding gate "$\overline{Q}$" back to a low rate, thus creating the descending slope of the output impulse. This low rate at the output "Q" of the tilting device 72 also results in the re-initialization of all secondary tilting devices 73, 74 putting all inversed outputs "$\overline{Q}$" to a high rate and thereby interlocking these tilting devices, thus preventing the ascent of the subsequent inversed signal. The gate "ET" 75 returns to a high rate, which action again releases the tilting device 72 and renders it suitable for the subsequent selection as long as a permission for that purpose is maintained on the line 85.

As may be gathered from FIG. 1, the device according to the invention includes, moreover, an analog/digital and digital/analog converter 90 acting jointly with a micro-processor 80, this device being capable of receiving on line 81 a rate of the basic voltage in order to return to the lines 82 an electric signal corresponding to the gains to be applied to the amplifying circuits 40 and 41 with automatic gain, and to the lines 83 a threshold rate for the comparator 63 of the circuits 60 and 61, said threshold being fixed between 100 and 400 millivolts above the background noise measured on the basic signal. The micro-processor also transmits to the line 85 a monitoring signal interlocking the selective circuit as long as no mark is awaited.

As may be gathered from the aforesaid comments, the device according to the invention permits an unfailing detection of a mark travelling through a light beam emitted by the source 20, the device effectuating a instantaneous selection of the best suited scanning channel for yellow or blue, simultaneously taking into account the color, the contrast and the intensity of the mark to be considered. For machines expected to carry out delicate jobs, it is quite possible to add a third or fourth parallel scanning channel for other well distinguishable colors. Numerous improvements may be added to this device within the limits of the invention.

Although various minor changes and modifications might be proposed by those skilled in the art, it will be understood that I wish to include within the claims of the patent warranted hereon all such changes and modifications as reasonably come within my contribution to the art.

I claim as my invention:

1. A device for scanning a mark printed on a plate or web-shaped workpiece travelling under a light source within a printing machine, comprising:

at least two parallel mark scanning channel means fed with scanning data by at least one fiber optic, each of said channel means emitting an electric impulse each time a mark travels through under said light source;

each channel means having a photosensitive means situated at an input thereof for responding to a color frequency range which is distinguishable from frequencies of the at least one other channel means; and each channel means having electronic means for selecting a most representative mark impulse between the electric impulses emitted by the at least two channel means.

2. A device according to claim 1 wherein each mark scanning channel means comprises:

said photosensitive means generating an electric signal for a voltage value;

automatic gain amplifying stage means for fixing at a predetermined rate a basic voltage corresponding to a non-printed area of the workpiece;

converting stage means following the amplifying stage means for converting an oblique sloped electric impulse resulting from a mark travelling under the photosensitive means into a steep sloped electric impulse, every steep slope corresponding to a beginning of ascent or descent of an associated oblique slope; and said electronic means selecting among the electric impulses originating from the at least two channel means at a given moment the electric impulse which appears or disappears first.

3. A device according to claim 2 each scanning channel means having before its converting stage means a rectifying stage means for imparting to all electric impulses a variation in a same direction with respect to said basic voltage.

4. A device according to claim 2 wherein said photosensitive means includes a photodiode situated behind a color filter, and said photodiode being connected to an input of a current/voltage converter.

5. A device according to claim 3 wherein said rectifying means includes a rating stage means for rating said basic voltage, a following subtracting stage means for subtracting said basic voltage so as to leave only positive or negative electric impulses, a following rectifying stage means for rectifying solely the positive impulses into negative ones, a following impulse adding stage means for adding all the impulses, and a following re-adding stage means for insuring a re-addition of said basic voltage.

6. A device according to claim 2 wherein said converting means comprises a first peak detecting stage means for detecting a threshold, a following subtracting stage means for subtracting from an input signal said threshold detected by said first peak detecting stage means and for outputting a difference, said difference being applied to a comparator means for tilting off as soon as said difference exceeds a predetermined threshold, a primary electronic means for re-initializing and inversing a detection direction of said peak detecting stage means, and a secondary electronic means for inversing a polarity of a comparative threshold applied to said comparator means after a first tilt of said comparative threshold.

7. A device according to claim 1 wherein said electronic means for selecting the electric impulses from the at least two channel means comprises a first gate receiving impulses from each of the channels at each of its inputs, its output connecting to a clock input of a first tilting device and as many secondary tilting devices as there are impulses corresponding to channel means to be analyzed, outputs of the first and second tilting devices being connected to an input of a second gate, an output of which is connected to a re-initialization input of said first tilting device, a re-initialization input of every secondary tilting device being connected to an output of said first tilting device, and a monitoring line for the electronic means being connected to an input of said second gate.

8. A device according to claim 3 wherein an analog/digital and digital/analog converter is connected to a microprocessor means, said microprocessor means being connected to receive from said rectifying means said basic voltage fixed at said predetermined rate, said microprocessor means feeding said automatic gain amplifying means with an electric signal representative for a gain to be applied, and also feeding said converting means with an electric signal representative of a threshold optimum for a comparator.

9. A device for scanning a mark printed on a plate or web-shaped workpiece travelling under a light source within a printing machine, comprising:

at least two parallel mark scanning channel means fed with scanning data, each of said channel means emitting an electric impulse each time a mark travels through under said light source;

each channel means having a photosensitive means situated at an input thereof for responding to a color frequency range which is distinguishable from frequencies of the at least one other channel means; and each channel means having electronic means for selecting a most representative mark impulse between the electric impulses emitted by the at least two channel means.

* * * * *